United States Patent [19]

Bodolay

[11] 4,112,652

[45] Sep. 12, 1978

[54] HOT WIRE PACKAGING MACHINE

[76] Inventor: William A. Bodolay, 5621 Live Oak Rd., Lakeland, Fla. 33803

[21] Appl. No.: 721,833

[22] Filed: Sep. 9, 1976

[51] Int. Cl.[2] ..... B65B 11/04

[52] U.S. Cl. ..... 53/211; 53/546; 53/582

[58] Field of Search ..... 53/32, 33, 178, 179, 53/198 R, 211, 212; 83/425, 425.4; 82/101

[56] References Cited

U.S. PATENT DOCUMENTS

| | | | |
|---|---|---|---|
| 539,659 | 5/1895 | Adamson | 53/211 |
| 718,747 | 1/1903 | Bernauer | 53/211 |
| 1,650,613 | 11/1927 | Dorman | 83/425.4 |
| 1,840,095 | 1/1932 | Henry | 82/101 |
| 1,870,519 | 8/1932 | Leguillon | 53/32 X |
| 2,050,394 | 8/1936 | Straubel | 53/23 |
| 2,446,618 | 8/1948 | Stephano | 53/179 X |
| 2,618,306 | 11/1952 | Magnuson | 82/101 X |
| 3,470,774 | 10/1969 | Phelps | 82/101 X |
| 3,491,507 | 1/1970 | Warfel | 53/33 X |
| 3,659,394 | 5/1972 | Hartleib | 53/33 |
| 3,760,559 | 9/1973 | Heinzer | 53/178 |

FOREIGN PATENT DOCUMENTS

| | | | |
|---|---|---|---|
| 2,236,587 | 2/1974 | Fed. Rep. of Germany | 53/211 |

*Primary Examiner*—John Sipos

[57] ABSTRACT

A packaging machine of the type primarily designed to package objects normally having an outer curvilinear configuration within heat shrinkable material. A conveyor assembly is mounted on a housing and maintained in continuous motion along a predetermined path of travel whereby the conveyor assembly comprises a plurality of roller elements at least a portion of which are maintained in constant rotary motion so as to impart this rotary motion to the material and the objects being packaged. A plurality of heated cutting elements are disposed in adjustable, spaced apart position in substantially transverse relation to the path of travel and in interruptive, severing relation to the material at least partially encasing the objects being packaged. A heat tunnel is further provided to apply an additional heat environment to the severed packaging so as to conform the packaging essentially to the configuration of the object being packaged.

9 Claims, 10 Drawing Figures

-12-
-16-
-22-

HOT WIRE PACKAGING MACHINE

BACKGROUND OF THE INVENTION

1. Field of the Invention

This invention relates to a packaging machine of the type primarily designed to package round or circular objects in a heat shrinkable or thermoplastic sheet like material wherein formation of the material to the general configuration of the package is accomplished through the specific application of heat either for the purpose of severing the material or specifically shrinking it to conform to the desired shape.

2. Description of the Prior Art

In all the industrialized nations of the world the packaging industry is constantly playing an increasingly important role in determining the consumer acceptability of various products designed to be presented on the open marketplace. Accordingly, manufacturers and/or distributors seriously consider various packaging methods and apparatus not only from the standpoint of aesthetic appearance of the packaged article but from the standpoint of economics in packaging costs, handling of the packaged product during display, storage or transportation and condition of the packaged object during storage or handling.

Serious consideration of various packaging apparatus is particularly important when dealing with objects having specifically peculiar or generally hard to handle configurations. Literally innumerable objects are constantly being packaged by an equally wide variety of methods and apparatus. It has been found that the packaging of generally circular objects or objects having a curvilinear border or periphery present certain problems inherent to these objects because of their specific configuration. In addition, objects such as rolls of tape, etc., include the additional characteristic of having certain surfaces thereof being subject to "sticking" or adhering to other rolls of tape due to the adhesive characteristic of the tape itself. More specifically, the lateral surfaces of certain adhesive rolls of tape are capable of becoming adhered to one another or to other objects, which causes a problem during separation of such rolls for actual use.

The packaging industry has conventionally tried to eliminate this problem by inserting various sheets of material in between the various rolls when the rolls are packaged together in a single package in a substantially stacked array. The material from which such sheets are made is normally formed from a non-adherent material and is also configured to substantially correspond to the configuration of the roll itself. Such sheet material is normally placed into engagement with both lateral surfaces of a roll of tape irrespective of whether a plurality of rolls are packaged together or not.

This prior art method, while substantially effective to prevent adherence of the rolls, adds certain cost factors to the packaging of this type of product as well as expanding the time utilized for packaging such objects.

Accordingly, there is an obvious need in the packaging industry for an apparatus and/or method of packing rolls of adhesive tape or like products wherein certain surfaces thereon have a tendency to become adhered to other similar objects. Such desired packaging requirements should take into consideration the general circular or curvilinear exterior configuration of the rolls during packaging. Further, such packaging apparatus should have sufficient versatility to package together a plurality of such rolls wherein the number comprising the plurality may greatly vary.

A review of prior art packaging apparatus reveals that a number of packaging apparatus have specifically been designed for the packaging of a wide variety of roll type articles. In particular, the patent to Hartleib, et al., U.S. Pat. No. 3,659,394, discloses a method and machine for wrapping articles with a sheet of material wherein the articles have a generally circular or roll type configuration. However, Hartiefb is not concerned with the separation of specific lateral surfaces of the various objects from one another when a plurality of such articles are packaged together.

In addition, the U.S. Pat. No. 3,355,857 to Tobey, discloses a method of using a heat shrinkable film for packaging a plurality of objects wherein specific apparatus is defined for trimming and/or severing material so as to define an ultimate package having a desired configuration, etc.

However, none of the above set forth prior art devices are specifically directed to problems inherently encountered in the packaging of rolls of adhesive tape or like objects wherein it is desired to package either one or a plurality of such objects together in a single packaging while at the same time eliminating the tendency for such objects to adhere together when arranged in a stacked array.

SUMMARY OF THE INVENTION

This invention relates to a packaging machine of the type primarily designed to package one or more objects having a round or generally circular configuration through the use of a heat shrinkable material in a manner which will prevent adherence of predetermined lateral surfaces of the various objects. More specifically, the packaging machine comprises a housing having a transport means in the form of a conveyor assembly movably mounted thereon and disposed to at least partially define a path of travel of both the packaging material and the objects being packaged. The conveyor assembly includes a substantially continuous configuration and is defined at least in part by a plurality of rollers disposed on the housing so as to be maintained in substantially constant rotary motion during at least a portion of its movement along the path of travel.

A material feed means is disposed between a material supply and in intercommunicating relation between the material supply and the conveyor assembly. The material feed means is further defined at least in part by a predetermined first portion or leading portion of the conveyor assembly wherein the material is movably directed from the supply along the path of travel due at least in part to the continuous movement of the conveyor assembly. Guide means are further provided in spaced apart but corresponding position relative to this predetermined first portion of the conveyor assembly. In addition, object delivery means are disposed to direct the objects into delivery on the conveyor assembly in the area of this predetermined first portion and into actual engagement with the packaging material.

Due to the linear motion of the conveyor assembly along the direction of the path of travel and the constant rotary motion of at least some of the plurality of rollers comprising the conveyor assembly, the packaging material travels along with the conveyor assembly in the direction of the path of travel concurrently to the objects being maintained in a constant rotary motion. Once both the objects being packaged and the packaging material pass beyond certain of the guide means comprising the material feed means, this motion of the conveyor assembly and the particular roller elements forces the material into a rotational direction of movement and into surrounding, encasing relation to the various objects being packaged.

A material severing means in the form of a plurality of heated cutting elements are disposed on the housing in generally interruptive relation to the material and the objects being packaged. More specifically, the plurality of heated cutting elements comprise elongated, linearly configured heated wires which are mounted on cutting frames, themselves being adjustably positioned in spaced relation to one another transversely across the path of travel followed by the objects being packaged as they travel along the conveyor assembly. The plurality of heated cutting elements are arranged at an angular orientation to the path of travel in a substantially declining relation thereto. Further, such heating elements are disposed essentially above the conveyor assembly itself so as to not interfere with its direction of travel. In that at least a predetermined number of the roller elements comprising the conveyor assembly are maintained in constant rotary motion, this rotary motion is imparted to the objects being packaged and the material being formed thereon as generally set forth above. Concurrent to this rotary motion of the objects being packaged they are brought into interruptive position relative to the plurality of heated cutting elements. Due to the fact that the packaging material itself is thermoplastic, the specific disposition of the plurality of cutting elements serves to sever this material and thereby roughly form and define the size of the packaged material about one or more of the objects being packaged. Due to the fact that the objects and the material are maintained in constant rotary motion simultaneously to passing through the heated cutting elements, the entire surface of the packaging material is severed in the area of the periphery of the objects being packaged. In addition, the heated cutting elements are allowed to be disposed above and in angular orientation to the path of travel as defined by the conveyor assembly. The ability to adjustably position the spacing between the various heated cutting elements allows for great versatility in determining the size of the package and accordingly the number of objects being disposed within a single package. The machine incorporating the generally described structure as set forth above further has the additional versatility of accommodating objects to be packaged having a wide variety of dimensions and generally different configurations.

Additional structural features of the present invention include sizing means comprising at least one heated element disposed in substantially transverse relation to the path of travel of the material as it is directed from its supply to the conveyor assembly. The sizing means as described is specifically provided for cutting or severing the packaging material into predetermined lengths dependent upon the appropriate dimensions of the objects being packaged. Such sizing means is movably or pivotally mounted on the housing and thereby activated to be pivotally brought into interruptive and/or cutting relation to the packaging material as it passes onto or along the conveyor assembly.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the nature and objects of the invention, reference should be had to the following detailed description taken in connection with the accompanying drawings, in which.

Similar reference characters refer to similar parts throughout the several view of the drawings.

DETAILED DESCRIPTION

Figure 1:
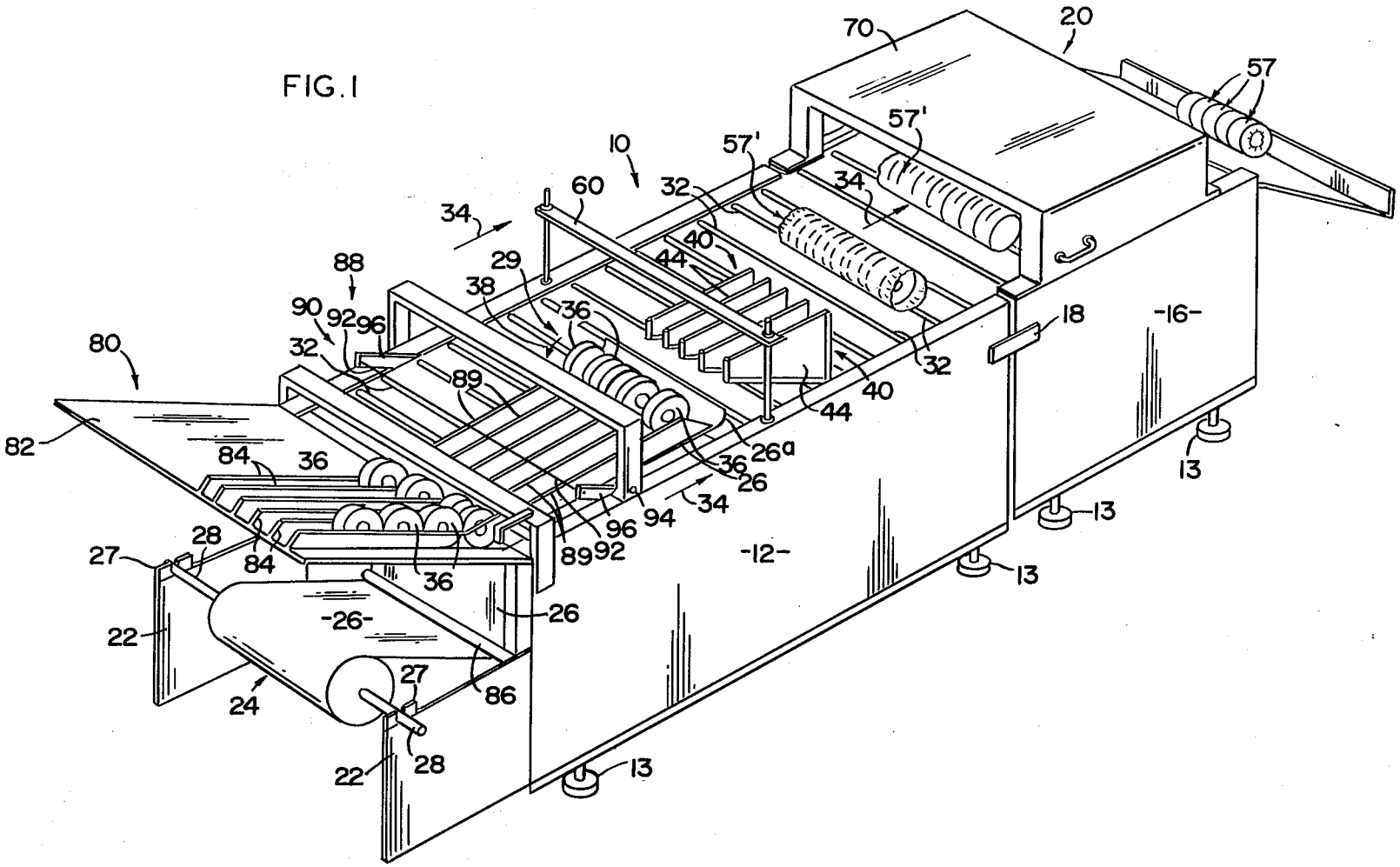
FIG. 1 is a perspective view of the packaging machine of the present invention.
Figures 2, 5, 6, 7, 8, 9, 10:
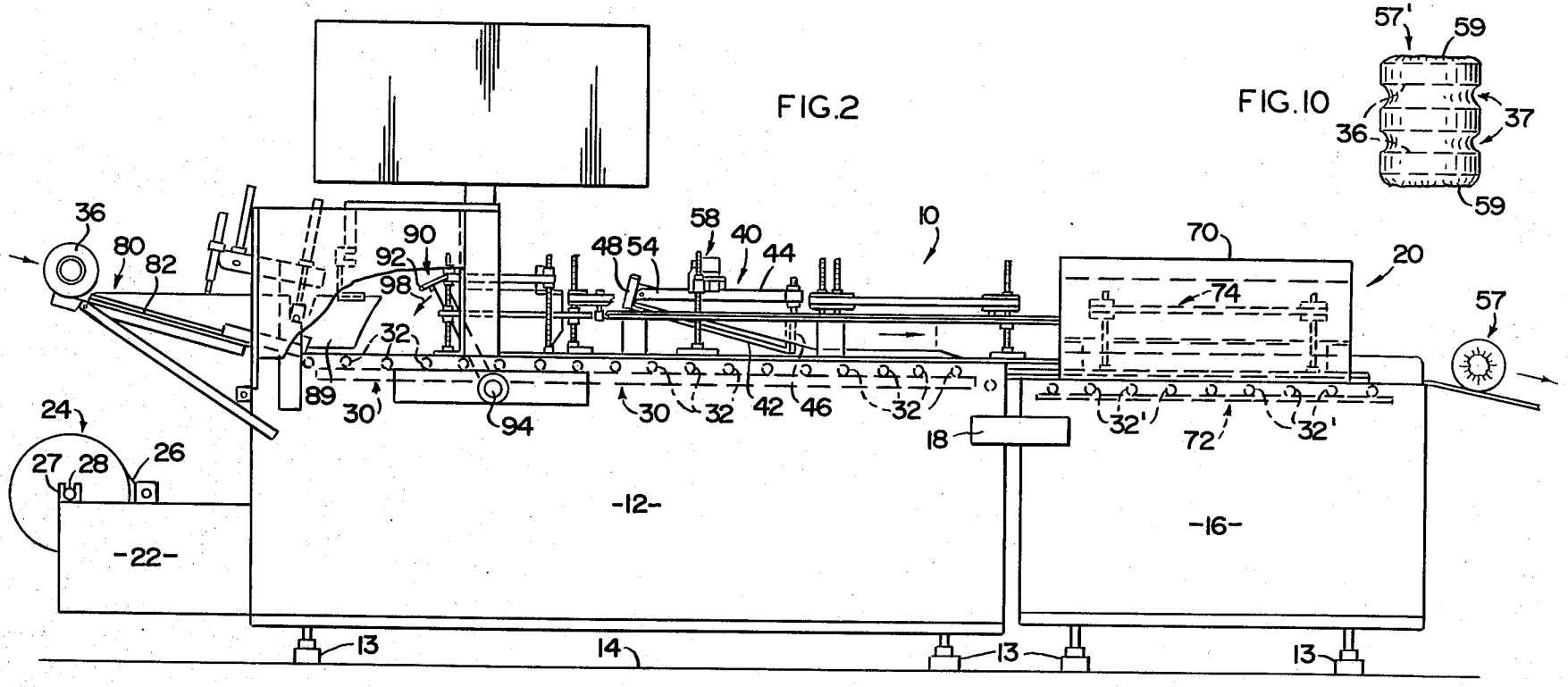
FIG. 2 is a side view of the embodiment shown in FIG. 1.
FIGS. 5 and 6 are schematic representations of the interaction between the object being packaged, the packaging material and the rotating roller elements as both the objects being packaged and the packaging material are maintained in constant rotary motion thereby.
FIG. 7 is a top, partial cutaway view, of the relationship of the heated cutting elements to the objects being packaged and the packaging material disposed in surrounded relation thereto.
FIG. 8 is a detailed, top view of a single object being packaged in the packaging material after being severed and leaving the plurality of heated cutting elements.
FIG. 9 is a side view of the embodiment of FIG. 8.
FIG. 10 is a top, detailed view of a plurality of objects being packaged together.

As shown in FIGS. 1 and 2, the packaging assembly of the present invention is generally indicated as 10 and comprises a housing 12 mounted by conventional support members 13 onto any type of floor or supporting surface 14. As will be explained in greater detail hereinafter, a supplementary housing portion 16 may be provided and interconnected to the main housing 12 by proper stabilization and interconnecting means 18. Similarly, conventional support members 13 may be used to support this supplementary casing 16 onto a floor or like support surface 14. This supplementary casing is used to provide a support platform for a heat tunnel assembly generally indicated as 20 and which will be explained in greater detail hereinafter.

The housing 12 comprises a material supply mount 22 having a material supply generally indicated as 24 mounted thereon by means of a support shaft 27 rotatably mounted in a cradle brace 28. Accordingly, the packaging material 26 is directed from the supply 24 to the material transport means generally indicated as 29.

The material transport means 29 comprises a conveyor assembly generally indicated as 30 and including a plurality of roller elements 32 disposed in spaced apart relation to one another and rotatably mounted on the remainder of the conveyor assembly. This rotational mounting serves to allow at least a predetermined number of the roller elements 32 to be maintained in a constant rotary motion as the conveyor assembly travels along the path of travel generally indicated by directional arrow 34. As will be explained in greater detail hereinafter, an important feature of the present invention is the maintenance of the objects being packaged 36 in a constant rotational directional movement as indicated by directional arrow 38. Similarly, it is important that the leading edge 26a of the material 26 be automatically directed around or in encasing relationship to the objects 36 as generally represented in FIG. 5. The particular structure of the present invention which accomplishes this constant rotary motion is the provision of maintaining rollers 32 in constant rotary motion as indicated by directional arrow 31 (FIG. 5). Indeed, this constant rotary motion is particularly important as the objects 36 and encasing packaging material 26 passes through the material severing means generally indicated in FIGS. 1 and 2 as 40.

More particularly, the material severing means comprises a plurality of heated cutting elements including elongated, linearly disposed wires 42 (FIG. 3) mounted on frame 44 so as to be disposed in an angular orientation to the defined path of travel as established by the conveyor assembly 28.

Figure 3:
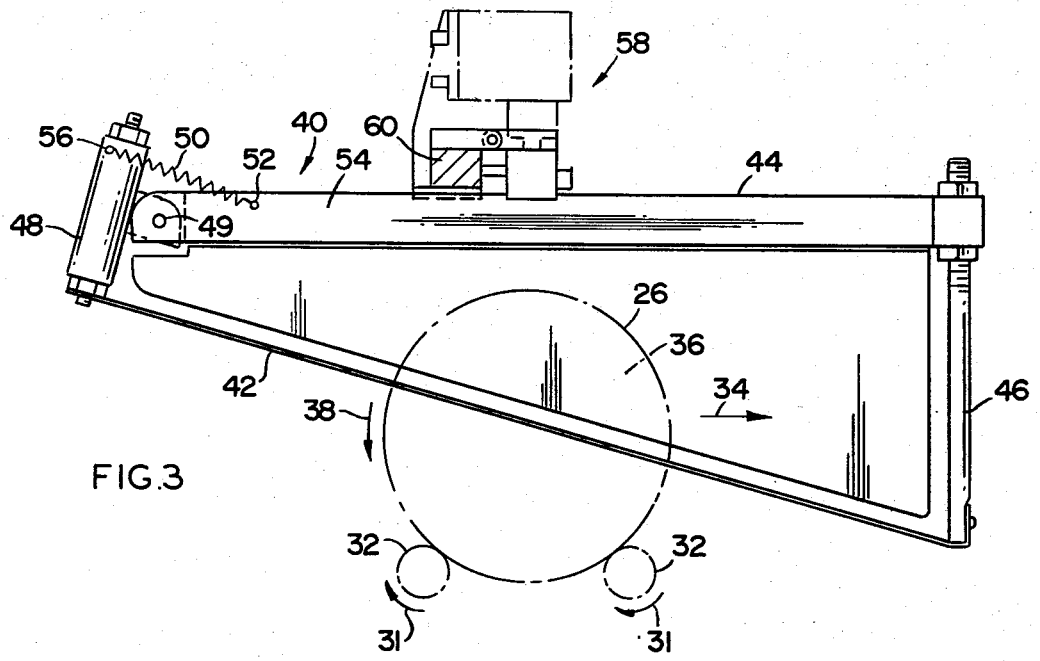
FIG. 3 is a detailed view of the material severing means showing the inclined relation and linear configuration of the heated cutting elements thereon.
Figure 4:
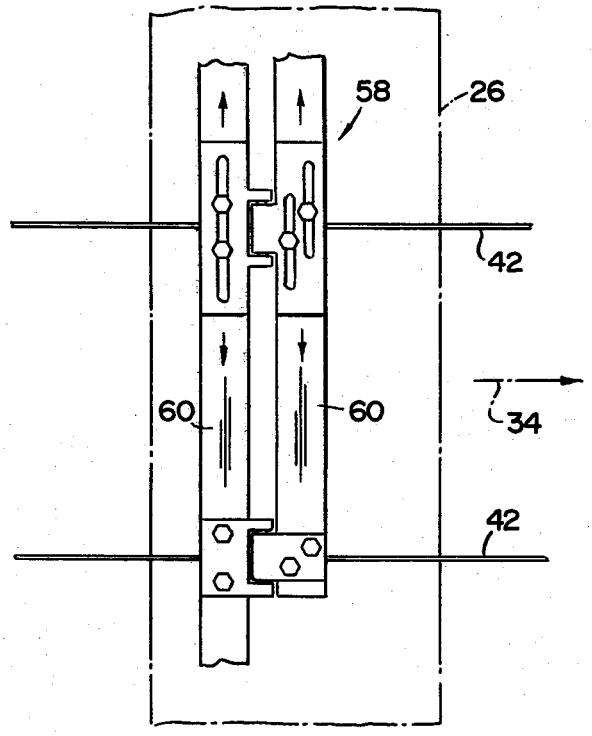
FIG. 4 is a detailed view, in partial cutaway, showing the adjustable mounting means for the plurality of heated cutting elements.

With regard to FIGS. 3 and 4, the heated elongated wire 42 is secured at one end to fixed brace 46 and its opposite end to a pivotal connecting brace 48. Connecting brace 48 is designed to be movably positioned about pivot point 49 and is maintained in an outwardly disposed relation (FIG. 3) by a biasing means 50. The biasing means 50 is connected at one end 52 to the frame brace 54 and at its opposite end to the support or connecting brace 48 as at 56. Accordingly, the heated wire element 42 is maintained in an outwardly extended relationship and is maintained in an essentially taut position. Connecting assembly generally indicated as 58 is provided to interconnect each of the plurality of severing means or more particularly each of the cutting elements in spaced apart, adjustable and movable relation on the housing 12 and more particularly on the attachment support 60 secured to the housing 12 in overlying relationship relative to the path of travel 34 and the conveyor assembly 28. By virtue of this arrangement each of the individual cutting elements may be disposed in varied spaced relation to one another entirely across the transverse dimension of the conveyor assembly. This is specifically advantageous so as to allow provision and versatility of packaging a plurality of objects in a single package. At this point it should be readily understood, with relation to FIG. 7, that as the package material 26 and the individual objects to be packaged 36 are maintained in constant rotary motion, they engage, in interruptive fashion the heated cutting elements 42. The packaging material 26 is thereby severed at the placement or disposition of each of the heated elements such that individual packages are formed (FIG. 8) and generally represented as 57. These individual packages are, of course, formed inside by their being severed as at 59 by the particular heated cutting elements 42 passing on each side of the object 36 that is being packaged.

It should further be made clear that due to the adjustable interconnection of the various heating elements and more particularly the frame 44 in varied spaced relation to one another along the transverse dimension of the conveyor assembly, a plurality of objects may be packaged together in a single package as represented by FIG. 10. In this embodiment the individual objects 36 have their adhesive lateral faces separated from one another due to the shrinkage of the material 26 into the space separating the various objects 36 as generally indicated at 37. While the end portions 39 are severed by the plurality of spaced apart heated cutting elements 42 the shrinkage as at 37 occurs after the entire package 57' passes through the heat tunnel assembly generally indicated as 20 and which will be explained in greater detail hereinafter.

Accordingly, the individual heating elements are allowed to be angularly oriented in a declining relation to the path of travel of the objects 36 and material 26 and be spaced substantially above and in non-interruptive relation to the conveyor assembly itself. By virtue of the constant rotary motion of the objects and the surrounding or encasing packaging material 26, the entire periphery of the packaging material is severed thereby forming the individual packages 57 and 57'.

With regard to the heat tunnel assembly 20 a tunnel housing 70 is mounted in encasing relation to the secondary portion of the conveyor assembly generally indicated as 72 (FIG. 2) which itself may provide a plurality of roller elements 32' similar to that described with regard to the conveyor assembly 28. Substantially conventional heating elements generally indicated as 74 are provided on the interior of the tunnel housing 70 so as to subject the severed and sized packages 57 and/or 57' to additional heat to cause the shrinkage as described with reference to FIG. 10. Similarly, as shown in FIG. 9, the shrinkage of the end portions 75 also occurs to the point where they adhere snugly to the external lateral faces of the endmost object being packaged 36 so as to form a complete and compact packaged article generally respresented as in FIG. 9.

Other structural features of the present invention, as best shown in FIG. 1 comprise an object feed assembly generally indicated as 80 which, in the preferred embodiment, provides an inclined base or support sheet 82 and a plurality of channels 84 particularly dimensioned and configured to maintain the roll like objects 36, to be packaged, in an upright relationship as they are fed into the transport means or the conveyor assembly 30 and 28, respectively.

Similarly, material feed means is used to direct the material 26 from the supply 24 to the transport means 30. This feed means comprises a directing roller 86 and further comprises a predetermined first or leading portion of the conveyor assembly indicated collectively and generally as 88. More specifically, the material is fed onto the first predetermined plurality of rollers 32 which define the leading or first portion of the conveyor assembly wherein due to this movement and also the provision of guide elements 89, the material travels along in the direction of the path of travel indicated as 34. In addition, the objects 36 tend to engage the conveyor assembly at this predetermined fixed portion of the conveyor assembly which defines at least a part of the material feed means as set forth above. Therefore the objects 36 are delivered directly onto the packaging material 26 which passes along the predetermined first portion of the conveyor assembly generally indicated as 88 in FIG. 1. By virtue of this movement both the packaging material 26 and the objects to be packaged 36 are transported along simultaneously while the objects 36 are being maintained in a constant rotary motion as indicated by directional arrow 38 and as set forth above. Also as previously explained, this constant rotary motion serves to force the leading edge 26a of the packaging material to follow up around and encase the objects being packaged 36 as best depicted in FIGS. 5 and 6.

Further structural features of the present invention includes a material sizing means generally indicated as 90 and including a heated cutting element 92 pivotally mounted to the housing 12 as at pivotal mount 94. A support arm 96 is located at opposite ends thereof and both are pivotally attached to the pivot mount 94. The opposite ends of each of these arms serves to support in a taut, stretched apart fashion the heated cutting element 92. Pivotal movement of the heated cutting element into transverse, interruptive relation to the packaging material 26 in the direction indicated by directional arrow 98 causes a severing of the packaging material 26 and thereby establishes or defines the various lengths into which the packaging material will be cut.

It will thus be seen that the objects set forth above, among those made apparent from the preceding description, are efficiently attained and, since certain changes may be made in the above construction without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described, what is claimed is:

1. A packaging machine of the type primarily designed to utilize heat shrinkable material in wrapping a plurality of objects having a predetermined configuration, said packaging machine comprising: a housing, transport means comprising a conveyor assembly movably mounted on said housing and at least partially defining a path of travel of material and objects being packaged; said conveyor assembly including wrapper means structured to wrap a plurality of separate objects in a single wrapper and comprising a plurality of roller elements rotatably attached to said conveyor assembly and disposed for constant rotary motion along at least a portion of said path of travel, a material severing assembly comprising a plurality of heated cutting elements disposed in spaced apart relation to one another, said plurality of heated cutting elements correspondingly positioned relative to said constant rotating roller elements and in interruptive disposition to the material and the objects being packaged, wherein each of said heated cutting elements comprise a substantially elongated configuration and extend along and in spaced above relation to said predetermined portion of said path of travel and further angularly oriented in a declining relation to said path of travel where constant rotary motion of said roller elements occurs, whereby the objects being packaged are maintained in rotary motion during severing of the material by said heated cutting elements into a plurality of individual packages.

2. A packaging machine as in claim 1 wherein each of said heated cutting elements is adjustably attached to said housing and movable relative to one another and in transverse direction relative to the direction of said path of travel, whereby spacing between each of said heated cutting elements may be varied.

3. A packaging machine as in claim 1 wherein each of said heated cutting elements comprise an elongated heated wire comprising a substantially linear configuration angularly oriented in a declining relation to said path of travel, the major portion of the length of said heated wire being disposed along said path of travel and in interruptive relation to the material traveling along said path of travel.

4. A packaging machine as in claim 1 further comprising material supply means mounted on said housing in communicating relation with said transport means, material feed means movably attached to said housing and including at least a portion of said transport means, said material feed means disposed at least in part in intercommunicating relation between said material supply means and said path of travel.

5. A packaging maching as in claim 4 wherein said material feed means comprises a predetermined first portion of said conveyor assembly, and further comprising guide means disposed in corresponding position above said predetermined first portion of said conveyor assembly, whereby the material is movably guided along said predetermined first portion due at least in part to the motion of said conveyor assembly.

6. A packaging machine as in claim 5 further comprising object delivery means mounted on said housing and disposed to movably direct the objects being packaged to said predetermined first portion of said conveyor assembly, said guide means mounted on said housing in the area of delivery of the objects being packaged to said predetermined first portion of said conveyor assembly, said constant rotating roller element disposed to define at least a portion of said predetermined first portion of said conveyor assembly, whereby the objects and the material are maintained in constant, substantially rotational movement as they pass in interruptive relation to said plurality of cutting elements.

7. A packaging machine as in claim 4 further comprising sizing means including a material cutter movably disposed in interruptive disposition across the path of travel and in transverse relation thereto.

8. A packaging machine as in claim 7 wherein said material cutter includes a heating element pivotally connected to said housing and positionable into interruptive, transverse relation to said path of travel and the material passing there along, upon pivotal movement of said material cutter.

9. A packaging machine as in claim 2 wherein said plurality of cutting elements are disposed in predetermined spaced relation to one another and are further collectively arranged for disposition along at least a major portion of the transverse dimension of said path of travel.

* * * * *

UNITED STATES PATENT AND TRADEMARK OFFICE

CERTIFICATE OF CORRECTION

PATENT NO. : 4,112,652

DATED : September 12, 1978

INVENTOR(S) : William A. Bodolay

It is certified that error appears in the above–identified patent and that said Letters Patent are hereby corrected as shown below:

Column 8, line 20, "maching" should read -- machine -- .

Signed and Sealed this

Fourteenth Day of November '978

[SEAL]

*Attest:*

RUTH C. MASON
*Attesting Officer*

DONALD W. BANNER
*Commissioner of Patents and Trademarks*